United States Patent [19]

Rock

[11] 4,375,307

[45] Mar. 1, 1983

[54] GROUNDING RECEPTACLE WITH LOW RESISTANCE GROUND

[75] Inventor: Brian E. Rock, Riverside, R.I.

[73] Assignee: General Electric Company, New York, N.Y.

[21] Appl. No.: 248,747

[22] Filed: Mar. 30, 1981

[51] Int. Cl.[3] ..... H01R 4/66

[52] U.S. Cl. ..... 339/14 R; 339/14 P

[58] Field of Search ..... 339/14 R, 14 L, 14 P, 339/95 D, 122 R, 159 R, 159 C, 164 R; 174/51

[56] References Cited

U.S. PATENT DOCUMENTS 3,432,793 3/1969 Muska et al. ..... 174/51 X 3,963,292 6/1976 Smith ..... 339/14 R 4,203,638 5/1980 Tansi ..... 339/14 P

FOREIGN PATENT DOCUMENTS 1026836 2/1978 Canada ..... 339/14 R

*Primary Examiner*—Eugene F. Desmond

*Attorney, Agent, or Firm*—Paul E. Rochford; Walter C. Bernkopf

[57] ABSTRACT

A grounding receptacle is provided with a low resistance grounding path. Low resistance is achieved at an interface between grounding contact and a steel grounding strap by including a surface treatment and surface coating of deposited tin metal.

4 Claims, 2 Drawing Figures

GROUNDING RECEPTACLE WITH LOW RESISTANCE GROUND

BACKGROUND OF THE INVENTION

This application relates generally to wiring devices of the wall receptacle type. It is known that such receptacles are conventionally made up of an insulating housing within which is mounted current carrying contacts. Such housing is also provided with a metal strap for mounting the receptacle within a wall box and for providing a ground fault current path.

Where the receptacles are used for high standard applications as in hospitals and the like, the strap is conventionally made of brass and is wrapped around the back of the device. Also, the grounding contact of such receptacles is connected to the mounting strap in many such designs. This connection provides a grounding path through the mounting strap.

Where high performance use as in hospital applications is desired, problems have arisen when attempts have been made to employ plated steel straps in mounting wiring devices inasmuch as there tends to be a generation of heat associated with the use of such steel straps where any current including fault current flows to ground.

OBJECTS OF THE INVENTION

In one of its broader aspects, objects of the invention are achieved by providing a receptacle having a plated steel mounting strap and having grounding contacts mounted to the plated steel mounting strap but having an improved conductor path provided for flow of grounding current. Such improved grounding path is achieved by coating the grounding contact with a tin or indium metal to a significant thickness.

Eyelets are employed to attach the tin or indium coated grounding contacts to the plated steel strap and the heat associated with use of such straps is thereby avoided.

It is one object of the invention to provide a high performance wall receptacle which does not have heating problems associated with flow of current to ground.

Another object of the invention is to provide a high performance wall receptacle which has a steel mounting strap.

Another object of the invention is to provide a high performance receptacle having a lower cost of materials and construction.

Another object of the invention is to provide a novel high performance receptacle with good conductivity between the grounding contact and the mounting strap to which such contacts are attached.

Other objects and advantages of the invention will be in part apparent and in part pointed out in the description which follows.

BRIEF DESCRIPTION OF THE DRAWING

The invention will be understood with greater clarity be reference to the accompanying drawing in which.

DETAILED DESCRIPTION OF THE INVENTION

Figure 1:
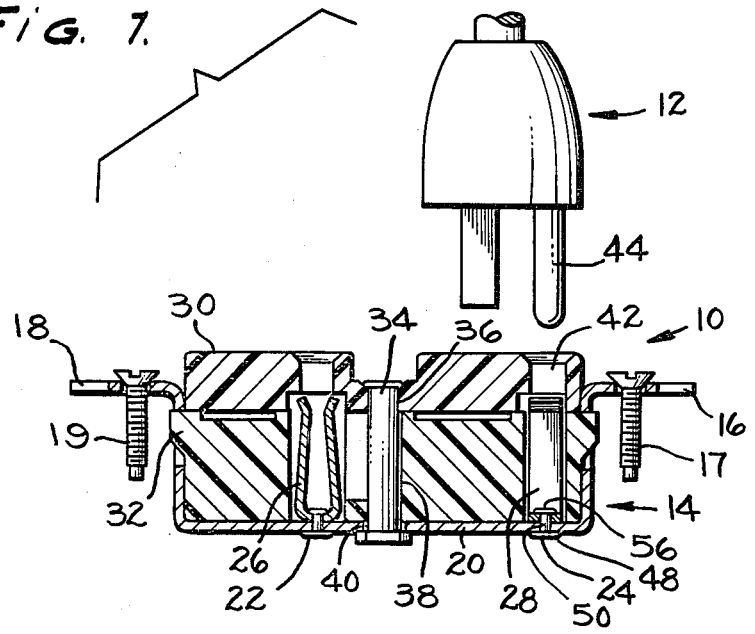
FIG. 1 is a vertical, sectional view of a receptacle as provided pursuant to the present invention with a plug mounted for assembly thereto.

Referring first to FIG. 1, a receptacle 10 is shown in vertical section and a plug 12 is shown poised above the receptacle for entry of its blade contacts into the receptacle.

The receptacle is made up of a mounting strap 14 having two end portions 16, 18 with mounting screws 17, 19 respectively, and having a bottom portion 20. The bottom portion 20 has two rivets 22, 24 which are mounted through the bottom 20 of the receptacle strap and also through the U-shaped grounding contacts 26, 28. Within the strap 14 there is positioned an insulating housing made up of an upper cover portion 30 and a base portion 32. The base and cover are held within the strap by an elongated rivet 34 extending through a conforming opening 36 in the cover 30, a conforming opening 38 in the base 32 and a conforming opening 40 in the strap 14.

The grounding contact 28 is positioned within a receiving opening 42 in the housing and receives the grounding blade 44 of the plug 12 to make contact therewith.

Figure 2:
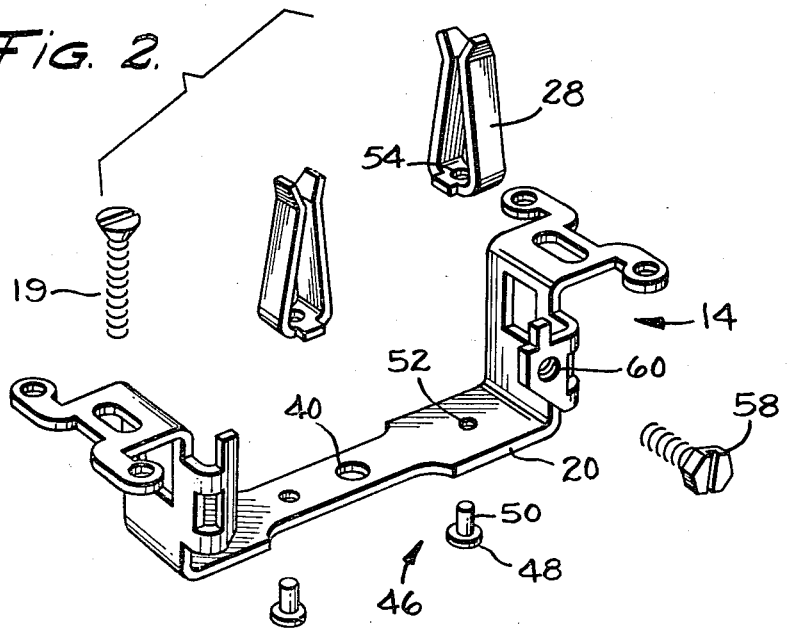
FIG. 2 is an exploded perspective view of a bracket of a receptacle with associated contacts shown in a preassembly arrangement.

Referring next to FIG. 2, it will be evident that the grounding contact 28 is assembled to the bottom portion 20 of the strap 14 by mounting of the contact 28 onto 20 and by inserting a rivet 46 through the respective openings to attach the contact to the base. The rivet stem 50 extends through opening 52 in base 20 and through opening 54 in contact 28 until the rivet head 48 is flush with the bottom of bracket portion 20 and the stem 50 is then headed to form head 56 as best seen in FIG. 1.

The contact 28 is provided with a tin or indium coating which is preferably formed by electrodeposition of a tin or indium layer on the surface of the contact 28. The tin or indium coating is put onto contact 28 prior to the rivet attachment of the contact 28 to base 20 of bracket 14.

It has been found that where the contact 28 is attached to the bracket 14 without such tin or indium coating, that a heating problem results when an appreciable current flows through the contact 28 and through the bracket 20 to ground as through a wire attached to the bracket 14 by the grounding screw 58 threaded into screw opening 60, or as through mounting screws 17, 19 contacting end portions 16, 18 of the mounting bracket and threaded into openings on a grounded wall box.

However, when a tin or indium layer has been formed on the contact 14 prior to assembly, the excessive heating caused by the flow of current to ground through contact 28 does not occur and accordingly there is provided pursuant to this invention a unique and novel structure which gives a high performance for the receptacle without the use of the very expensive materials which are employed in receptacles of similar performance.

What is claimed and sought to be protected by Letters Patent of the United States is as follows:

1. A receptacle comprising an insulating body containing current carrying contacts, a mounting strap mounted about said insulating housing, a grounding contact mounted to the mounting strap, said grounding contact being coated with a relatively thick coat of tin metal; and said contact being riveted to said mounting strap after being tin-coated or indium-coated.

2. The article of claim 1 in which the mounting strap is plated steel.

3. The article of claim 1 in which each grounding contact is tin plated.

4. The article of claim 1 in which the coating is of indium.

* * * * *